US006056642A

United States Patent [19]

Bennett

[11] Patent Number: 6,056,642

[45] Date of Patent: May 2, 2000

[54] SLOT MACHINE WITH COLOR CHANGING SYMBOLS

[75] Inventor: Nicholas Luke Bennett, Manly Vale, Australia

[73] Assignee: Aristocrat Leisure Ind. Pty Ltd., New South Wales, Australia

[21] Appl. No.: 08/977,874

[22] Filed: Nov. 25, 1997

[30] Foreign Application Priority Data

Nov. 27, 1996 [AU] Australia ..... P03877

[51] Int. Cl.[7] ..... A63F 9/22

[52] U.S. Cl. ..... 463/20; 463/31; 273/143 R

[58] Field of Search ..... 463/20, 31, 19, 463/18, 17, 16, 25, 13, 12; 273/143 R

[56] References Cited

U.S. PATENT DOCUMENTS

| | | | |
|---|---|---|---|
| 4,618,150 | 10/1986 | Kimura | 273/143 R |
| 5,152,529 | 10/1992 | Oleada | 273/143 R |
| 5,188,363 | 2/1993 | Mainell, II et al. | 463/13 |
| 5,393,061 | 2/1995 | Manship et al. | 463/20 |
| 5,395,111 | 3/1995 | Snoue | 463/20 X |
| 5,542,669 | 8/1996 | Charron et al. | 463/13 |
| 5,752,881 | 5/1998 | Snoue | 463/20 |
| 5,772,506 | 6/1998 | Marks et al. | 463/13 |

*Primary Examiner*—Michael O'Neill
*Attorney, Agent, or Firm*—Friedman Siegelbaum LLP

[57] ABSTRACT

A slot machine 10 has three rotatable reels 12 carrying symbols 14 which are controlled by stepper motors and are arranged to pay prizes on the occurrence of a predetermined symbol or combination of symbols. A jackpot prize is paid on the occurrence of three 7s on the win line. The 7s are against a clear background and when three 7s appear on the display the display colour may change to three red 7s, three blue 7s, three white 7s or three 7s of mixed colour. If the three 7s all change to a red colour, the jackpot prize is paid, otherwise a lesser prize is paid. The colouring of the 7 occurs by backlighting the 7s in the reels by means of coloured light bulbs or similar means. The presence of the above feature on a gaming machine allows that gaming machine to pay a jackpot which is several times greater than would normally be paid. For example if each 7 has all equal chance of becoming white, blue or red, then the chance of all three reels turning red is 1 in 27 and therefore a jackpot prize of approximately 27 times greater than all identical gaming machine without the feature of the present invention can be paid.

12 Claims, 3 Drawing Sheets

SLOT MACHINE WITH COLOR CHANGING SYMBOLS

BACKGROUND OF THE INVENTION

The present invention relates to slot machines also known as fruit machines and poker machines and which will be referred to hereinafter by the generic term "gaming machines". In particular, the invention provides an improvement to a game played on such a gaming machine.

DESCRIPTION OF THE PRIOR ART

Gaming or poker machines have been well known in various states in the USA and in many countries throughout the world for many years.

Traditional slot machines have made use of spinning reels, usually controlled by stepper motors, to provide a display function with symbols carried on the reels being aligned to produce a game result which may, or may not be, a winning combination. Traditionally, such machines paid a prize only on a centre row combination, however, over the years more complex pay arrangements have been developed in which winning combinations could appear on horizontal lines above and below the centre row line.

Players who regularly play gaming machines, quickly tire of particular games and it is therefore necessary for manufacturers of gaming machines to come up with either innovative game features that add interest to the games provided on such machines, or provide new games in order to keep the players amused and willing to continue playing gaming machines.

Recently, the gaming machine market has experienced considerable growth and there is intense competition between manufacturers of gaming machines to supply the various existing and new venues. Clearly the revenue raised by an operator of a particular venue depends on the amount of money wagered. The amount of money wagered on a particular machine is related to the popularity of the machine. Thus, when selecting a supply of game machines, the operator of a venue often paid close attention to the popularity of the various games with their patrons.

With a gaming machine having spinning reels controlled by stepper motors, because the machine is essentially electro-mechanical, there is a physical limit to the amount of additional interest and game features which can be added to the gaming machine.

A further limitation on such gaming machines is the size of the jackpot. The jackpot available on a particular gaming machine depends on the probability of a particular winning line occurring which in turn depends on the size of the reels and the number of symbols on the reels. By way of example, for a gaming machine having the traditional three reels, if each reel carried only ten symbols, and a particular winning symbol appeared once only on each reel, the probability of the reels aligning the three particular winning symbols on the pay line would be one in a thousand. Thus on a machine which merely broke even, and only paid a jackpot for the combination of those three winning symbols, a jackpot of 1000 credits could be offered for a one credit wager. Of course, usually, other combinations of symbols also pay prizes and on average gaming machines retain a proportion of monies wagered. Hence, on such a machine the jackpot prize payable would be much smaller than 1000 credits. One solution to this problem is to increase either the number of reels, or the size of the reels and the number of symbols on a particular reel. However, there is obviously a physical limit to the size and number of reels which can be provided, governed by the size of the standard gaming machine cabinet, the costs involved in making oversize machines, and the reluctance of gaming machine operators to have oversized gaming machines in their venues. Consequently there is a tendency for the use of video displays simulating spinning reels since this allows, inter alia, the use of virtual reels which can be of almost infinite size, and also enables the provision of animation and other innovative game features provided by suitable control of the video display means, to increase player interest.

However, many players of gaming machines prefer the traditional spinning style gaming machines where they can see a physical reel spinning and believe that such machines are inherently more trustworthy and honest. Many players have a distrust of video simulations of gaming machines and believe that they have a poor chance of winning on such machines and they may also believe that there is more scope for winning on the traditional style machines by the exercise of their skill and experience in playing such gaming machines.

Thus it is an object of the present invention to alleviate the disadvantages of the prior art discussed above and to provide an improved game for a gaming machine.

SUMMARY OF THE INVENTION

The present invention consists in a gaming machine having display means, and game control means arranged to control images displayed on the display means, the game control means being arranged to play a game wherein a plurality of symbols are randomly selected and displayed on the display means and, if a winning combination results, the machine pays a prize, the game being characterised in that the gaming machine is arranged so that on the occurrence of a particular combination of symbols, a further random change takes place to those symbols and if a particular change occurs, a jackpot prize is paid.

The present invention is most suitable for gaming machines of the traditional poker machine style in which the display means comprises a set of rotatable reels, each reel carrying a plurality of symbols. Once three matching symbols have occurred on the stepper reel, for example, three grey 7s, the symbols are caused to change colour. When a very particular colour change takes place a jackpot prize is paid.

For example, the 7s on display may change to either three red 7s, three blue 7s, three white 7s or three 7s of mixed colour. If, and only if, the 7s change to red 7s, the jackpot prize is paid.

The symbols are preferably illuminated by back-lighting for example the portion of the reel where the 7s are located may be clear plastic and an array of coloured light bulbs may be provided behind the symbol with the lighting of an appropriate bulb colouring the background to the symbol. Alternatively the symbols may have a white background and be coloured with incident light.

Alternatively, the gaming machine may have an LED or dot matrix display with three 7's on constant display. Once three 7's occur as a result of the spinning reels, the display changes colour.

The invention is also applicable to traditional poker machine style gaining machines in which the spinning reels are simulated on a video screen. In the case of a video simulation clearly no back or instant lighting would be required since the colour of the symbols or even the appearance of the symbols can be changed by the game control means. The feature may also be applied to other games such as card games, keno and bingo type games.

A specific embodiment of the invention will now be described by way of example only and with reference to the accompanying drawings in which:

FIG. 1 illustrates a first embodiment of the present invention implemented on a traditional spinning reel type of poker machine; and FIG. 2 illustrates an embodiment of the present invention implemented on a gaming machine having a video display simulating a spinning reel; and FIG. 3 is a schematic diagram of a game control means for the embodiment shown in FIG. 2.

DETAILED DESCRIPTION OF THE PREFERRED EMBODIMENTS

In the following detailed description, the methodology of the embodiments will be described, and it is to be understood that it is within the capabilities of the non-inventive worker in the art to introduce the methodology on any standard microprocessor-based gaming machine by means of appropriate programming.

Figure 1:
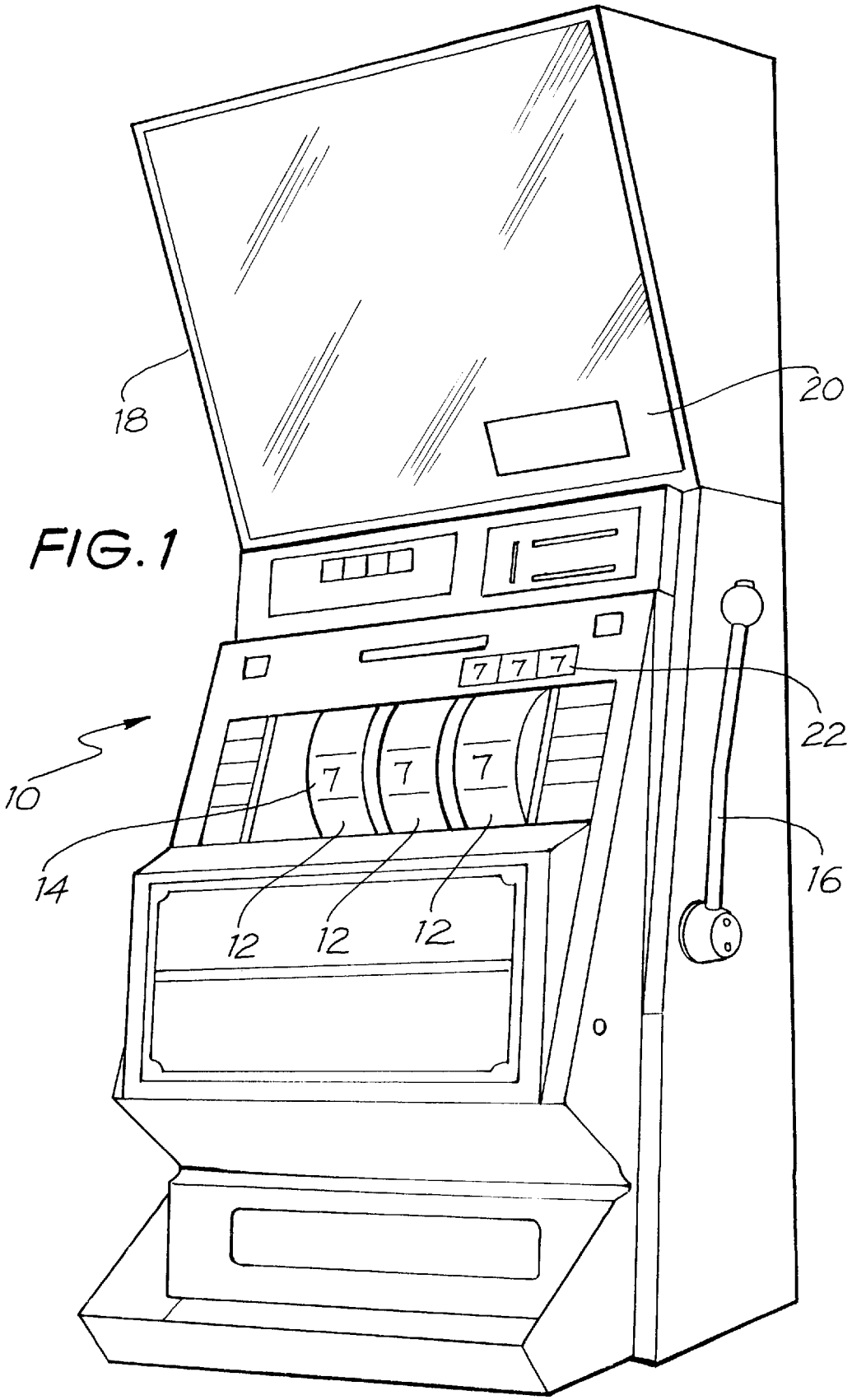

Referring to FIG. 1 of the drawings, the first embodiment of the invention is illustrated in which a slot machine, generally indicated at 10 of the type having a plurality (in this case three) of rotatable reels 12 carrying symbols 14 is arranged to pay a variable prize on the occurrence of a predetermined symbol or combination of symbols on a win line.

In the slot machine 10 illustrated in FIG. 1, the game is initiated by a pull handle 16, however, it will be recognised by persons skilled in the art that this operating mechanism might be replaced by a push button actuator of a different initiation device in other embodiments of the invention.

The top box 18 on top of the slot machine 10 includes a display 20 which illustrates the various winning combinations for which a price is paid.

In the illustrated embodiment the payment or not of a jackpot prize is determined by the occurrence of three 7s on the win line as shown in FIG. 1. The 7s are against a clear background and when three 7s appear on the display the display colour may change to three red 7s, three blue 7s, three white 7s or three 7s of mixed colour. If the three 7s all change to a red colour, the jackpot prize is paid otherwise a lesser prize associated with three 7s of that particular colour or colour mix is paid. The colouring of the 7 occurs by backlighting the 7s in the reels by means of coloured light bulbs or similar means.

In an alternative embodiment the 7s may be drawn on a white background and the reel coloured with incident light.

Alternatively, the gaming machine may have an LED or dot matrix display with three 7's on constant display. Once three 7's occur as a result of the spinning reels, the display changes colour. This display is shown at 22 on FIG. 1.

The presence of the above feature on a gaming machine allows that gaming machine to pay a jackpot which is several times greater than would normally be paid. For example if each 7 has an equal chance of becoming white, blue or red, then the chance of all three reels turning red is 1 in 27 and therefore a jackpot prize of approximately 27 times greater than an identical gaining machine without the feature of the present invention can be paid. Thus the present invention increases the attractiveness of a gaming machine to a player.

Figure 2:
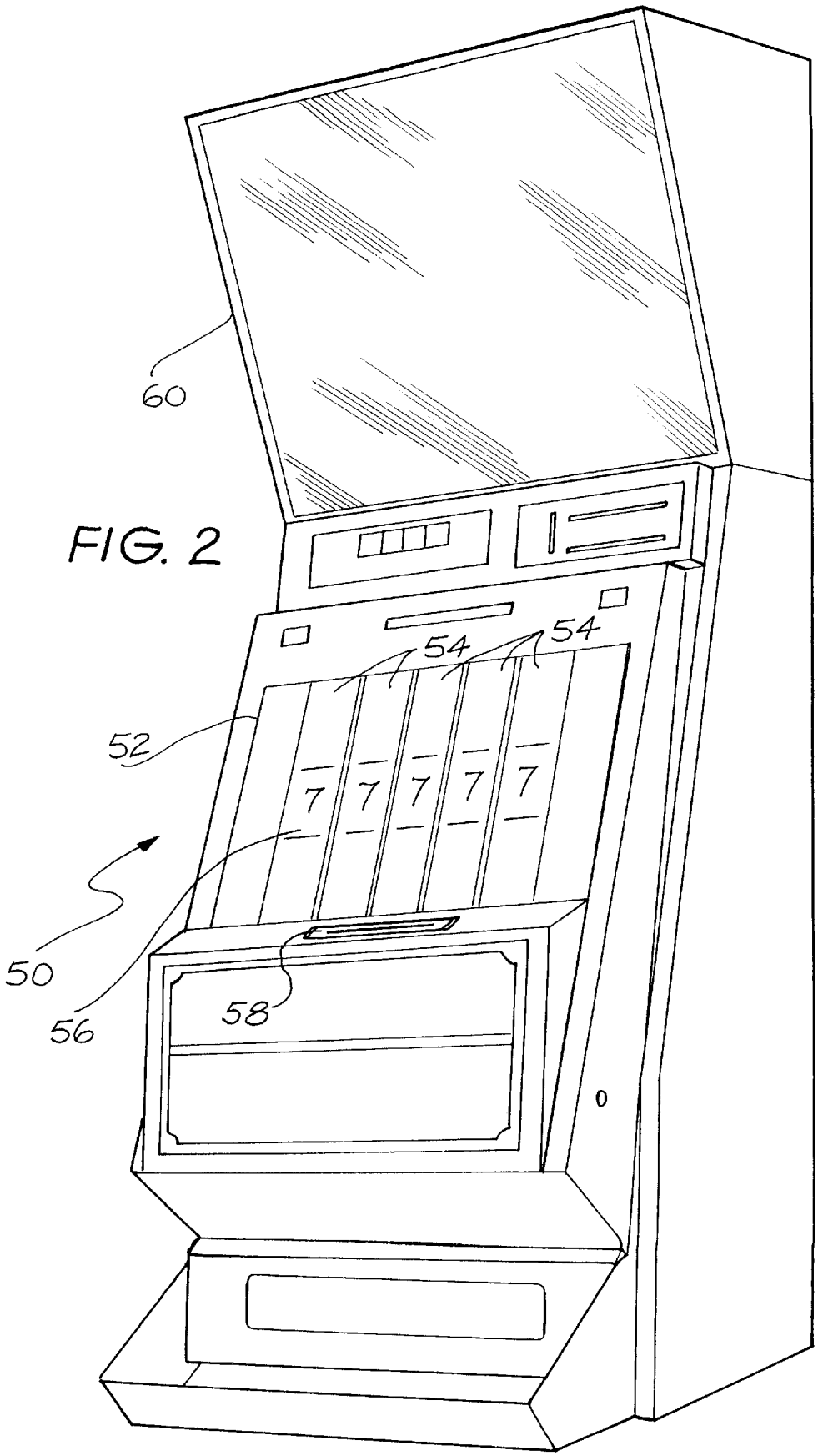

Turning to FIG. 2, a video version of the embodiment of FIG. 1 is illustrated, in which a slot machine 50 is provided with a video screen 52 on which five spinning reels 54 are simulated, each of the spinning reels having a plurality of symbols 56 similar to the physical symbols in the embodiment of FIG. 1. Games on this machine are initiated by operation of a button 58 below the video screen.

The top box 60 again carries information prize winning combinations.

The present invention is equally applicable to gaming machines having more than one pay line and any number of reels although a typical traditional style poker machine will have three or four reels only.

In the embodiment shown in FIG. 2 because the symbols themselves can change when the requisite number of 7s appears in the win line which, as the embodiment of FIG. 2 allows five reels, could be five or fewer, instead of the background of the symbols changing colour, the 7 symbols themselves may change to a different symbol altogether, and depending on what they change to, a jackpot prize may or may not be paid.

Figure 3:
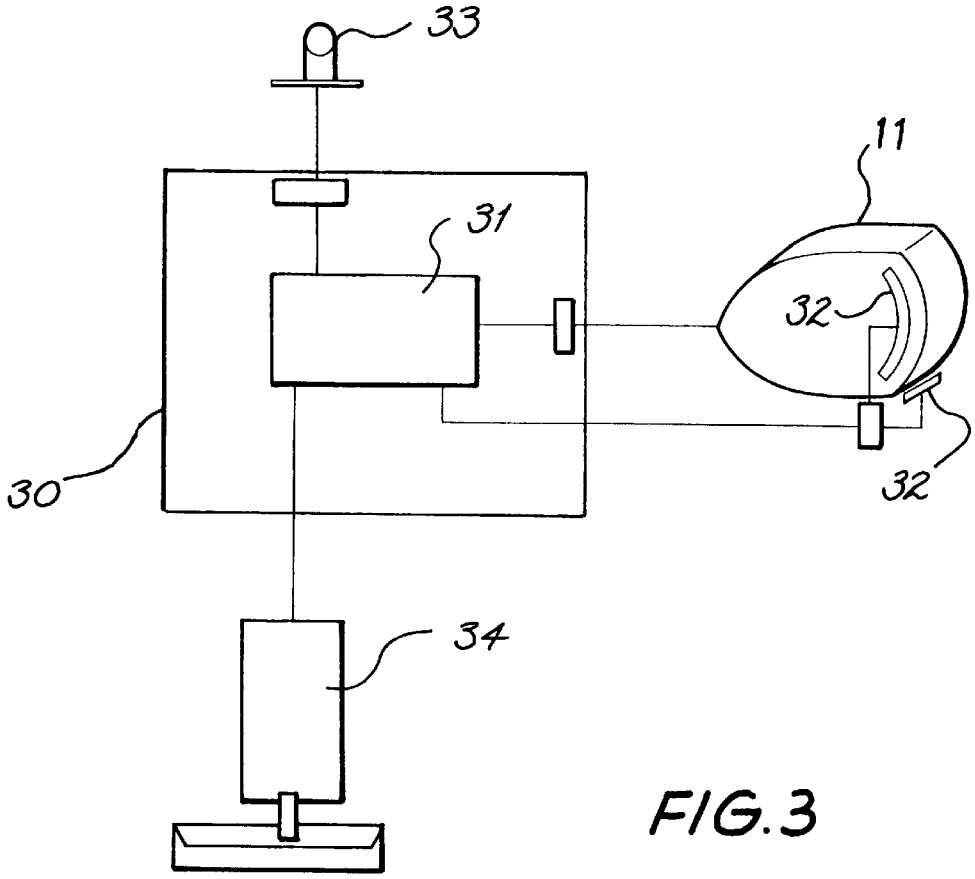

The program to implement the game runs on a standard gaming machine control processor 31 as illustrated schematically in FIG. 3. This processor forms part of a controller 30 which drives the display screen 11 and receives touch input signals from touch sensors 32 as well as receiving coin input pulses from a coin chute mechanism 33 and driving a coin payout mechanism 34.

The machine shown in FIG. 2 may also be configured to run a keno, bingo or card game, in which on the occurrence of particular combinations of symbols, a colour change to the symbols (or their background) occurs and depending on the change an additional prize may be paid.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine having a display means, and a game control means arranged to control images displayed on the display means, the game control means being arranged to play a game wherein a plurality of symbols are randomly selected and displayed on the display means and, if a winning combination results, the machine pays a prize, wherein the game is arranged so that on the occurrence of a particular combination of symbols, a further random change takes place to those symbols and if a particular change to the symbols occurs, a jackpot prize is paid.

2. A gaming machine as claimed in claim 1, wherein the display means comprises a set of rotatable reels operated by stepper motors, each reel carrying a plurality of symbols and wherein when three particular matching symbols appear on a win line, the symbols are caused to change colour and if a predetermined colour change takes place, a jackpot prize is paid.

3. A gaming machine as claimed in claim 2, wherein the colour change is effected by illuminating the symbols with back-lighting.

4. A gaming machine as claimed in claim 3, wherein the portions of the reel on which the symbols are located are made of a transparent material and an array of coloured lighting means are provided behind the symbol with the operation of an appropriate lighting means colouring the background to the symbol.

5. A gaming machine as claimed in claim 1, wherein the spinning reels are simulated on a video screen and the appearances of the symbols on the display are changed by the game control means.

6. A gaming machine as claimed in claim 3, wherein the gaming machine includes a housing and at least the matching winning symbols are defined by an LED or dot matrix display provided on the housing of the gaming machine with the three symbols, on constant display, and wherein if the three matching winning symbols occur on a win line as a result of the reels spinning, the LED or other matrix display changes color.

7. A gaming machine as claimed in claim 2, wherein the symbols are 7s and the 7s may change to either three red 7s, three blue 7s, three white 7s or three 7s of mixed colour and wherein, if and only if, the 7s change to red 7s, a jackpot prize is paid.

8. A gaming machine having a display means, and a game control means arranged to control images displayed on the display means, the game control means being arranged to play a game wherein a plurality of symbols are randomly selected and displayed on the display means and, if a winning combination results, the machine pays a prize, wherein the game is arranged so that on the occurrence of a particular combination of symbols, a color change takes place to those symbols or to the background of those symbols, and if a particular color change occurs, a jackpot prize is paid.

9. A gaming machine as claimed in claim 8, wherein the spinning reels are simulated on a video screen and the appearance of the symbols on the display or their background is changed by the game control means.

10. A gaming machine as claimed in claim 8 or 9, wherein the game played, is a card game, keno or bingo.

11. A gaming machine having a display means, and a game control means arranged to control images displayed on the display means, wherein the display means comprises a set of rotatable reels operated by stepper motors, each reel carrying a plurality of symbols, the game control means being arranged to play a game wherein a plurality of symbols are randomly selected by the rotation of the reels and displayed on a win line of the display means and, if a winning combination results, the machine pays a prize, wherein the game is arranged so that on the occurrence of a particular combination of matching winning symbols, the symbols are caused to change colour and if a predetermined colour change takes place, a jackpot prize is paid.

12. A gaming machine as claimed in claim 11, wherein the symbols have a white background and are coloured with incident light.

* * * * *